United States Patent [19]

Kistner

[11] Patent Number: 4,890,974

[45] Date of Patent: Jan. 2, 1990

[54] EASY CONNECTION OF DIPPER STICK TO TOOL OF AN EARTH WORKING MACHINE

[76] Inventor: David Kistner, 4028 Mohegan Ave., Huber Heights, Ohio 45424

[21] Appl. No.: 306,051

[22] Filed: Feb. 6, 1989

[51] Int. Cl.[4] ..... E02F 3/40

[52] U.S. Cl. ..... 414/723; 172/272; 414/786

[58] Field of Search ..... 172/272-275, 172/245; 37/71, DIG. 12, 118 R, 103; 414/723, 786

[56] References Cited

U.S. PATENT DOCUMENTS

| | | | |
|---|---|---|---|
| 3,874,533 | 4/1975 | Montgomery et al. | 172/272 X |
| 4,127,203 | 11/1978 | Arnold | 172/272 X |
| 4,187,050 | 2/1980 | Barbee | 37/103 X |
| 4,225,283 | 9/1980 | Baker et al. | 172/272 X |
| 4,373,852 | 2/1983 | Maurer | 172/272 X |
| 4,643,631 | 2/1987 | Maurer et al. | 172/272 X |
| 4,836,741 | 6/1989 | St. Louis et al. | 172/272 X |

FOREIGN PATENT DOCUMENTS

| | | | |
|---|---|---|---|
| 1456538 | 1/1969 | Fed. Rep. of Germany | 414/723 |

OTHER PUBLICATIONS

Caterpillar, Change to the Tools That Can Do Your Jobs Right, AEDC6889 Backhoe Buckets For Every Application.

Caterpillar, 416 Backhoe Loader, AEHQ2708(7-87), pages 3 and 5.

*Primary Examiner*—Randolph A. Reese
*Assistant Examiner*—Jeffrey L. Thompson
*Attorney, Agent, or Firm*—Jacox & Meckstroth

[57] ABSTRACT

Guide structure for assisting in the connection of a dipper stick of a machine, such as a back-hoe to a tool, such as a bucket, which is operated by the machine. The tool has a connection portion provided with a pair of aligned openings. The dipper stick has a tubular connection member which must be aligned with the openings in the connection portion for attachment of the tool to the dipper stick. In this invention a pair of guide flanges is attached to the connection portion of the tool. Each guide flange has an abutment portion which is positioned adjacent one of the openings in the connection portion. In the procedure of attachment of the dipper stick to the tool, the dipper stick is moved, and the tubular connection portion is guided along the guide flanges until the tubular connection member engages the abutment portions of the guide flanges. When the tubular connection member engages the abutment portions of the guide flanges, the tubular connection member is in alignment with the openings in the connection portion of the tool, and a fastener is inserted through the opening and through the tubular connection member, and the dipper stick is thus attached to the tool.

2 Claims, 2 Drawing Sheets

EASY CONNECTION OF DIPPER STICK TO TOOL OF AN EARTH WORKING MACHINE

BACKGROUND OF THE INVENTION

An earth working machine, such as a back hoe or the like, has a dipper stick or force arm or the like. A tool, such as a bucket, which is attached to the dipper stick may be frequently removed, replaced by another tool, and then reattached.

Conventionally, a dipper stick has a tubular horizontal connection member which is transverse to the longitudinal axis of the dipper stick. A tool, such as a bucket, has a connection portion which is provided with a pair of spaced-apart openings. In order to attach the dipper stick to the bucket, the tubular connection member must be positioned between the pair of openings and in alignment therewith. Then an elongate connection pin is inserted through the openings and through the tubular connection member. Then the elongate connection pin is secured in position by any suitable means. Thus, the bucket is secured to the tubular connection member and the dipper stick is pivotally attached to the bucket.

In the past, considerable time and difficulty has been experienced in connecting a dipper stick to a tool, such as a bucket. This problem results from the fact that the operator of the machine has difficult in observing the position of the tubular connection member of the dipper stick with respect to the spaced-apart openings in the connection portion of the bucket. It has been necessary for the machine operator to have an assistant who is an observer and guide, or it has been necessary for the operator to leave the operating position and walk to the bucket to observe the position of the tubular connection member of the dipper stick with respect to the spaced-apart openings in the connector portion of the bucket. Then the operator must return to the operating position to move the dipper stick and the tubular connection member to attempt to align the tubular connection member with the spaced-apart openings in the connection portion of the bucket. It may be necessary for the operator to repeat this procedure several times in order to obtain alignment of the tubular connection member with the openings in the connection portion of the bucket. Of course, this type of procedure is time consuming and thus is objectionable.

It is therefore an object of this invention to provide alignment means by which a dipper stick of an earth working machine is easily and readily attached to a bucket, or other earth working device or tool.

It is another object of this invention to provide such alignment means which can be a part of any tool which is attachable to a dipper stick or the like.

It is another object of this invention to provide such alignment means which is readily adaptable to a conventional connection means.

It is another object of this invention to provide such alignment means which is producable at relative low costs.

Other objects and advantages of this invention reside in the construction of parts, the combination thereof, the method of construction and the mode of use, as will become more apparent from the following description.

SUMMARY OF THE INVENTION

This invention pertains to a bucket or other tool which is adapted to be attached to a dipper stick of an earth working machine. Conventionally, the bucket or other tool has a connection portion which is provided with a pair of spaced-apart aligned openings. The dipper stick has a tubular connection member which must be positioned between the spaced-apart openings and in alignment therewith, in order to attach the dipper stick to the bucket. When this alignment exists, a fastener member is inserted through the openings and through the tubular connection member to secure the tubular connection member and the dipper stick to the bucket.

This invention includes alignment means and abutment means which are attached to the connection portion of the bucket or other tool. The alignment means are positioned adjacent the spaced-apart aligned openings.

In the procedure of attachment of the tubular connection member of the dipper stick to the bucket, the tubular connection member of the dipper stick is moved along the alignment means and is thereby directed into engagement with the abutment means. When the tubular connection member of the dipper stick is in engagement with the abutment means, the tubular connection member is properly aligned with the openings in the connection portion of the bucket. Thus, a fastener member can be readily inserted through the spaced-apart openings and through the tubular connection member for attaching the dipper stick to the bucket.

DETAILED DESCRIPTION OF THE PREFERRED EMBODIMENT

Figure 1:
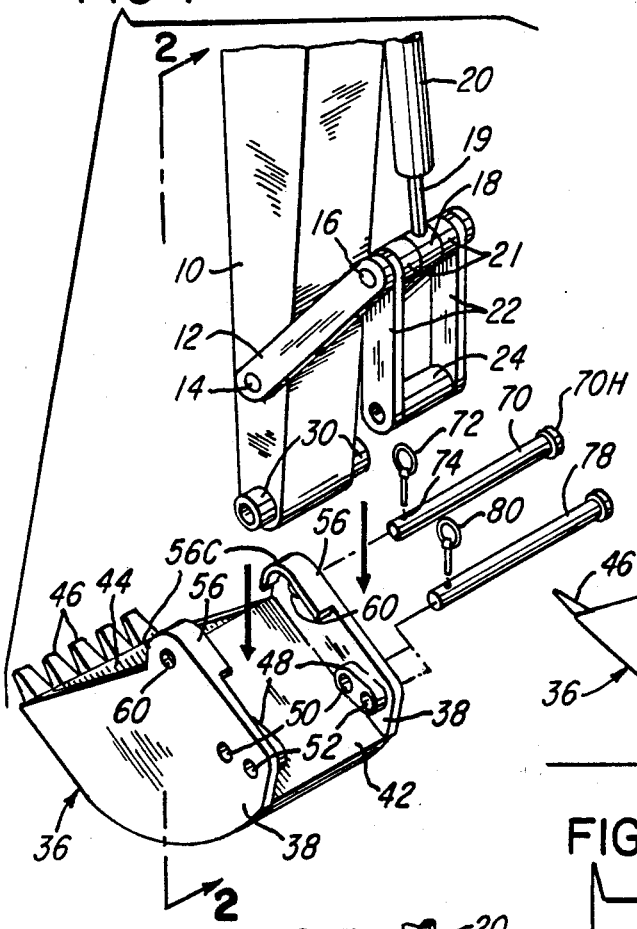
FIG. 1 is a fragmentary exploded perspective view, illustrating an initial step in attachment of a dipper stick or force arm to a bucket which includes guide means of this invention.

FIG. 1 shows a dipper stick or force arm 10. A pair of levers 12 are pivotally attached to the dipper stick 10 by means of a shaft 14, which extends through the dipper stick 10. A shaft 16, at the ends of the levers 12, attaches the levers 12 to a coupler ring 18. The coupler ring 18 is rotatably positioned upon the shaft 16. The shaft 16 also extends through spacer members 21, between which the coupler ring 18 is positioned. The coupler ring 18 is attached to an actuator rod 19 of a fluid motor 20.

The shaft 16 also extends through spaced-apart link members 22 which extend downwardly from the shaft 16. At the lower end of the link members 22 is an auxiliary connection tube 24 which is attached to the link members 22.

At the lower end of the dipper stick 10, and secured thereto, is a tubular connector member 30. The tubular connector member 30 is shown as extending laterally from the dipper stick 10 at opposite portions thereof.

A bucket 36 has spaced-apart side walls 38 and a top wall 42. The bucket 36 also has a curved bottom and back wall 44. At the forward part of the bucket 36, teeth 46 are attached to the bottom and back wall 44.

The side walls 38 extend upwardly from the top wall 42. Attached to the side walls 38 above the top wall 42 are bearing members 48. Each bearing member 48 has openings 50 and 52 therethrough which are aligned with openings 50 and 52 in the side walls 38. In the forward portion of each side wall 38, above the top wall 42, is an opening 60. The openings 60 in the spaced-apart side walls 38 are substantially in alignment.

Figure 3:
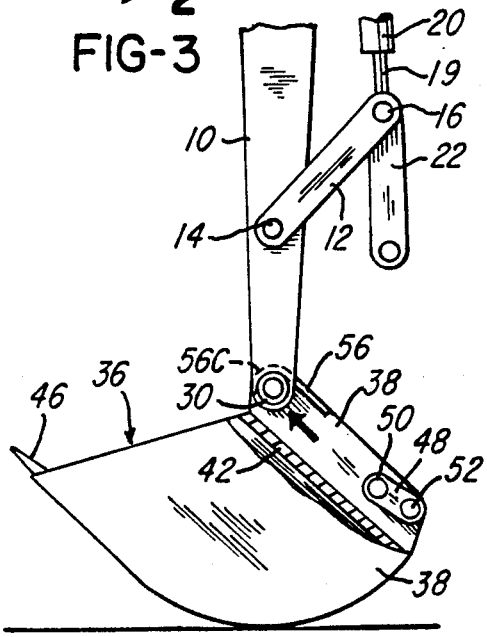
FIG. 3 is a fragmentary side sectional view, similar to FIG. 2, illustrating a succeeding step in the connection of the dipper stick to the bucket.
Figure 4:
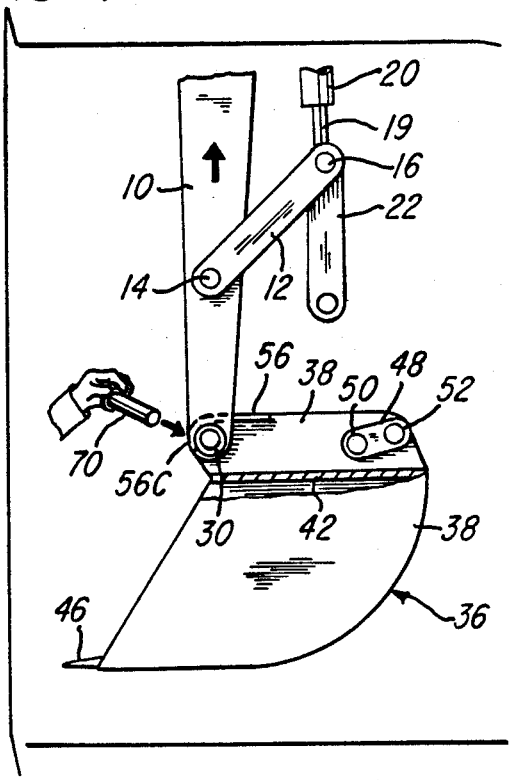
FIG. 4 is a fragmentary side sectional view, similar to FIGS. 2 and 3, illustrating a succeeding step in connection of the dipper stick to the bucket.
Figure 5:
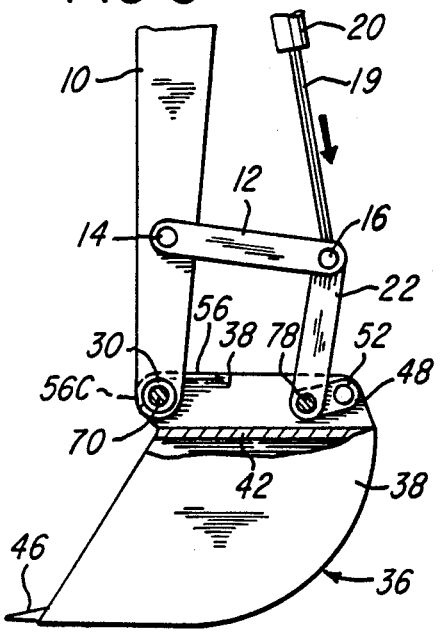
FIG. 5 is a fragmentary side sectional view, similar to FIGS. 2, 3, and 4, illustrating a final step in connection of the dipper stick to the bucket.

At the forward portion of the bucket 36 and above the top wall 42 and attached to each side wall 38 is a guide flange 56 which extends over a part of the top wall 42 and which is shown as having a curved abutment portion 56C. The curved abutment portion 56C of each guide flange 56 is positioned adjacent the respective opening 60 in the side wall 38 to which the guide flange 56 is attached. Preferably, as illustrated in FIGS. 3, 4, and 5, the abutment portion 56C is an arc generated from a point which is at the center of the respective opening 60. The guide flanges 6 and the curved abutment portions 56C thereof form alignment means which are carried by the side walls 38 above the top wall 42.

Operation

Figure 2:
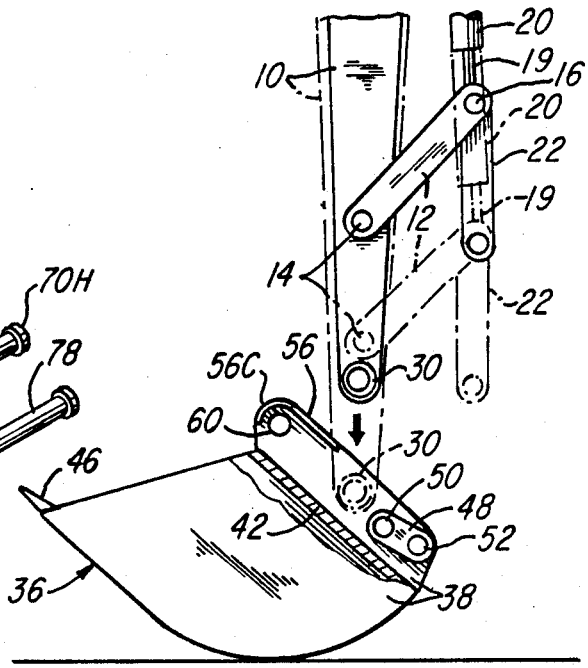
FIG. 2 is a fragmentary side view, drawn substantially on line 2—2 of FIG. 1, with parts broken away and shown in section showing the bucket and dipper stick of FIG. 1 and illustrating a subsequent step in the connection of the dipper stick to the bucket.

When it is desired to attach the bucket 36 to the dipper stick 10, the dipper stick 10 is lowered as illustrated in FIGS. 1 and 2. The dipper stick 10 is lowered until the tubular connector member 30 is positioned rearwardly of the guide flanges 56 and between the side walls 38 and above the top wall 42. The tubular connector member 30 has a length which is slightly less than the space between the side walls 38. As stated, the tubular connector member 30 is first positioned rearwardly of the guide flanges 56 and between the side walls 38. Then the lower end of the dipper stick 10 is moved forwardly so that the end portions of the tubular connector member 30 are moved forwardly immediately below the flanges 56. As stated, the tubular connector member 30 has a length which is slightly less than the space between the side walls 38. Therefore as the tubular connection member 30 is moved forwardly below the flanges 56, slight upward movement of the tubular connector member 30 by the dipper stick 10, causes engagement of the end portions of the tubular connector member 30 with the lower surfaces of the flanges 56. Therefore, movement of the tubular connector member 30 along the lower surfaces of the flanges 56 guides the tubular connector member 30 into engagement with the abutment portions 56C of the flanges 56.

When the tubular connector member 30 is in engagement with the abutment portions 56C of the guide flanges 56, the tubular connector member 30 is in alignment with the openings 60 in the side walls 38. If desired, when the tubular connector member 30 is in engagement with the abutment portions 56C of the flanges 56, the forward part of the bucket 36 can be lifted by the tubular connector member 30 and the dipper stick 10, as illustrated in FIG. 3. Lifting of the bucket 36 by means of the tubular connection member 30, as the tubular engagement member 30 engages the abutment portions 56C of the flanges 56, is optional, and is only for the purpose of assuring that there is proper alignment of the tubular connection member 30 with the openings 60 in the side walls 38.

When the tubular connector member 30 engages the abutment portions 56C of the guide flanges 56, alignment of the tubular connector member 30 with the openings 60 in the side walls 38 is assured. Therefore, a connection pin 70 can be moved through the openings 60 in the side walls 38 and through the tubular connector member 30, as illustrated in FIG. 4. The connection pin 70 is shown as having a head 70H. When the connection pin 70 is inserted through the openings 60 and through the tubular connector member 30, a cotter pin 72, or the like, is inserted through a passage 74 in the end of the connection pin 70 opposite the head 70H. Thus, the connector pin 70 is attached to the tubular connector member 30, and the bucket 36 is pivotally attached to the dipper stick 10.

Then the fluid motor 20 is operated to move the actuator rod 19 downwardly, as illustrated in FIG. 5. The auxiliary connection tube 24 is readily aligned with the openings 50 in the bearing members 48. Then a connection pin 78 is inserted through the openings 50 and through the auxiliary connection tube 24. A cotter pin 80, or the like, is inserted through the end of the connection pin 78. Thus, the auxiliary connection tube 24 and the link members 22 are attached to the bucket 36, as illustrated in FIG. 5.

FIG. 6

Figure 6:
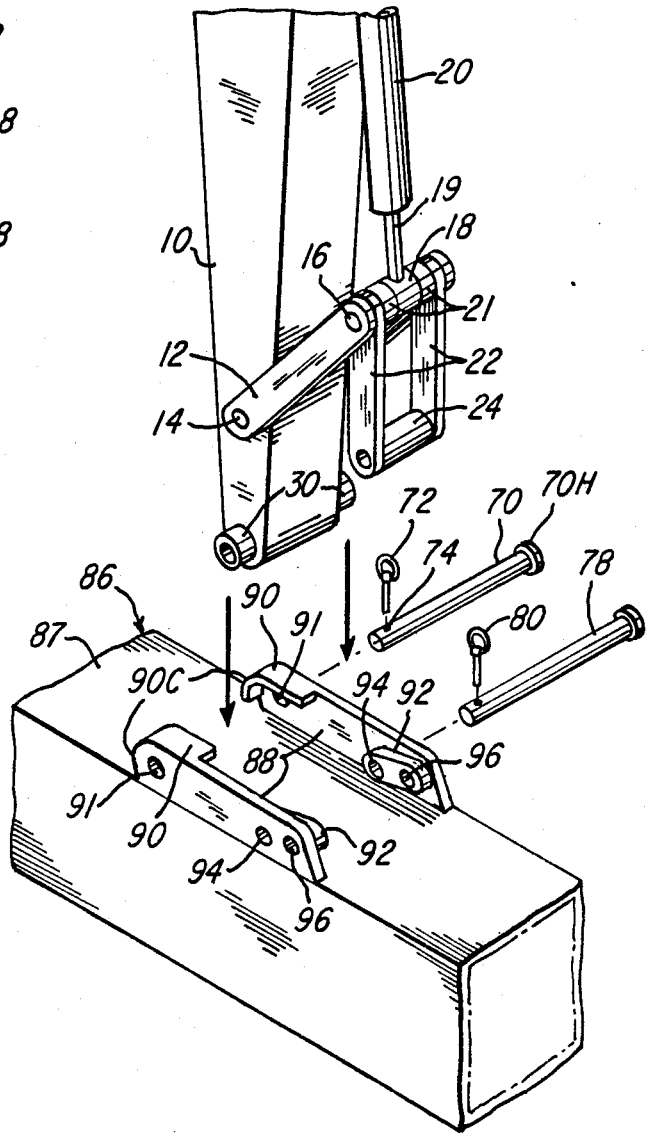
FIG. 6 is a fragmentary exploded perspective view illustrating another device or tool, which is attachable to the dipper stick and illustrating connection of the dipper stick to the device or tool.

FIG. 6 shows a portion of another tool 86. The tool 86 has a wall 87 to which is attached connection plates 88. Each of the connection plates 88 has an opening 91 therethrough. Also, attached to each of the connection plates 88 is a bearing member 92, which has openings 94 and 96 therethrough. Guide flanges 90 are attached to the connection plates 88. Each of the guide flanges 90 has an abutment portion 90C. Each of the abutment portions 90C is adjacent the opening 91 in the respective connection plate 88.

The spacing between the connection plates 88 is only slightly greater than the length of the tubular connector member 30. When it is desired to attach the dipper stick 10 to the tool 86, the dipper stick 10 is lowered as illustrated and discussed above. The lower end of the dipper stick 10 and the tubular connector member 30 are positioned between the connection plates 88 and rearwardly of the flanges 90 and forwardly of the bearing members 92. Then the lower end of the dipper stick 10 and the tubular connector member 30 are moved forwardly immediately below the flanges 90. Preferably, as forward movement of the tubular connector member 30 occurs and as the tubular connector member 30 is below the guide flanges 90, the tubular connector member 30 engages the guide flanges 90. Thus, the tubular connector member 30 is guided into engagement with the abutment portion 90C of the guide flanges 90.

When the tubular connector member 30, engages the abutment portions 90C of the flanges 90, the tubular connector member 30 is aligned with the openings 91 in the connection plates 88. Then the connection pin 70 is inserted through the openings 91 and through the tubular connector member 30, and the cotter pin 72 is inserted through passage 74 in the end of the connection pin 70. Thus, the tubular connection member 30 is attached to the tool 86. Then the fluid motor 20 is energized, and the link members 22 and the auxiliary connection tube 24 are lowered until the auxiliary connection tube 24 is aligned with the openings 94 or 96 in the bearing members 92. Then the connection pin 78 is inserted through the openings 94 or 96 and through the auxiliary connection tube 24, and the cotter pin 80 is inserted through the end of the connection pin 78. Thus, the link members 22 are attached to the connection plates 88, and the tool 86 is ready for movement and operation by the dipper stick 10.

Thus, it is understood that this invention provides means by which any tool can be easily and readily attached to a dipper stick of a machine, such as a backhoe or the like.

Although the preferred embodiment of the apparatus of this invention has been described, it will be understood that within the purview of this invention various changes may be made in the form, details, proportion and arrangement of parts, the combination thereof, and the mode of use, which generally stated consist in a structure or method within the scope of the appended claims.

The invention having thus been described, the following is claimed:

1. The method of attaching a tool to a dipper stick of a machine in which the tool has a pair of spaced-apart elongate connection plates parallel to each other each of the connection plates having an opening there through, the dipper stick having a tubular connection member carried thereby, comprising providing guide means including abutment means, in which the guide means comprises a pair of elongate guide members, each elongate guide member to one of the connection plates with the length portion substantially normal to its respective connection plate and projecting laterally from its respective connection plate and parallel to an upper edge thereof and with the abutment means adjacent the openings through the connection plates, moving the dipper stick and positioning the tubular connection member between the connection plates, moving the dipper stick and the tubular connection member in close relationship to the guide means until the tubular connection member engages the abutment means, whereby the tubular connection member is positioned in alignment with the openings through the connection plates, followed by inserting a fastener member through the openings in the connection plates and through the tubular connection member, whereby the tubular connection member and the dipper stick are attached to the tool.

2. A tool attachable by means of a connection pin to a dipper stick of a machine, the dipper stick having a lower end portion which is provided with a tubular connection member, the tool being provided with a pair of spaced-apart elongate connection plates parallel to each other, each of the connection plates having an opening therethrough, a pair of elongate guide members, each of the elongate guide members having an abutment portion, each of the elongate guide members having a length portion, each elongate guide member being attached to one of the connection plates with the abutment portion thereof adjacent the opening therethrough and with the length portion of the guide member substantially normal to its respective connection plate and with the length portion projecting laterally from its respective connection plate and parallel to an upper edge thereof whereby the tubular connection member of the dipper stick can be positioned between the connection plates and moved into close relationship to the elongate guide members, and guidingly moved along the length portion of the guide members until the tubular connection member engages the abutment portions of the guide members, whereby the tubular connection member is positioned in alignment with the openings through the connection plates and whereby the connection pin can be inserted through the openings in the connection plates and through the tubular connection member, whereby tubular connection member and the dipper stick are attached to the tool.

* * * * *

UNITED STATES PATENT AND TRADEMARK OFFICE

CERTIFICATE OF CORRECTION

PATENT NO. : 4,890,974

DATED : January 2, 1990

INVENTOR(S) : David Kistner

It is certified that error appears in the above-identified patent and that said Letters Patent is hereby corrected as shown below:

On the title page,
in the Abstract, 2nd line from the bottom, "opening" should read---openings---.

Column 1, line 27, "difficult" should read---difficulty---.

Column 3, line 29, "6" should read---56---.

Column 5, line 27, after "other" insert---,---.
line 32, after "members," insert---each elongate guide member having a length portion, attaching---.

Column 6, line 27, after "thereof" insert---,---.

Signed and Sealed this

Sixteenth Day of October, 1990

*Attest:*

HARRY F. MANBECK, JR.

*Attesting Officer*

*Commissioner of Patents and Trademarks*